US009782824B2

(12) United States Patent
Imai et al.

(10) Patent No.: US 9,782,824 B2
(45) Date of Patent: Oct. 10, 2017

(54) CONTINUOUS CASTING EQUIPMENT

(71) Applicant: NIPPON STEEL & SUMITOMO METAL CORPORATION, Tokyo (JP)

(72) Inventors: Shuntaro Imai, Tokyo (JP); Yasuo Maruki, Tokyo (JP); Daisuke Miki, Tokyo (JP); Hiroaki Uchiyama, Tokyo (JP)

(73) Assignee: NIPPON STEEL AND SUMITOMO METAL CORPORATION, Tokyo (JP)

( * ) Notice: Subject to any disclaimer, the term of this patent is extended or adjusted under 35 U.S.C. 154(b) by 54 days.

(21) Appl. No.: 14/766,041

(22) PCT Filed: Apr. 28, 2014

(86) PCT No.: PCT/JP2014/061845
§ 371 (c)(1),
(2) Date: Aug. 5, 2015

(87) PCT Pub. No.: WO2014/178369
PCT Pub. Date: Nov. 6, 2014

(65) Prior Publication Data

US 2015/0367408 A1 Dec. 24, 2015

(30) Foreign Application Priority Data

May 2, 2013 (JP) ..... 2013-096809

(51) Int. Cl.
*B21B 1/46* (2006.01)
*B22D 11/12* (2006.01)
(Continued)

(52) U.S. Cl.
CPC ..... *B22D 11/12* (2013.01); *B21B 1/46* (2013.01); *B21B 27/021* (2013.01);
(Continued)

(58) Field of Classification Search
CPC ..... B21B 1/46; B21B 1/463; B21B 27/021; B21B 13/22; B22D 11/12; B22D 11/1206;
(Continued)

(56) References Cited

U.S. PATENT DOCUMENTS 4,846,254 A * 7/1989 Kimura ..... B21B 1/463 164/154.3
4,955,428 A * 9/1990 Schrewe ..... B22D 11/1206 164/417
(Continued)

FOREIGN PATENT DOCUMENTS

JP 55-68102 A * 5/1980 ..... B21B 1/46
JP 55-106601 A * 8/1980 ..... B21B 1/02
(Continued)

OTHER PUBLICATIONS

Machine Translation of JP55-106601, Aug. 1980.*
(Continued)

*Primary Examiner* — Edward Tolan
(74) *Attorney, Agent, or Firm* — Birch, Stewart, Kolasch & Birch, LLP

(57) ABSTRACT

Continuous casting equipment includes a casting product reduction apparatus and a casting product drawing apparatus, the casting product reduction apparatus including a pair of casting product reduction rolls that sandwich and apply pressure to a casting product and being configured to apply reduction to the casting product, the casting product drawing apparatus being provided in a following stage of the casting product reduction apparatus and configured to sandwich and draw the casting product with a pair of casting product drawing rolls. At least one of the pair of casting product reduction rolls includes a large-diameter part that projects radially outward in an axial-direction center region and applies pressure to a width-direction center region of the
(Continued)

casting product. The casting product that is subjected to reduction by the casting product reduction apparatus has a depressed part corresponding to the large-diameter part. At least one of the pair of casting product drawing rolls of the casting product drawing apparatus includes a depressed part supporting part that contacts with and supports the depressed part, and is driven by a driving mechanism. An axial-direction length $L_2$ of the depressed part supporting part and an axial-direction length $L_1$ of the large-diameter part of the casting product reduction roll satisfy $0.5 \times L_1 \leq L_2 < L_1$.

2 Claims, 4 Drawing Sheets

(51) Int. Cl.
*B22D 11/128* (2006.01)
*B21B 27/02* (2006.01)
*B21B 13/22* (2006.01)

(52) U.S. Cl.
CPC ..... *B22D 11/1206* (2013.01); *B22D 11/1282* (2013.01); *B22D 11/1287* (2013.01); *B21B 13/22* (2013.01)

(58) Field of Classification Search
CPC ..... B22D 11/1282; B22D 11/1287; Y10T 29/49991
See application file for complete search history.

(56) References Cited

U.S. PATENT DOCUMENTS 5,238,047 A * 8/1993 Sakata ..... B22D 11/128 164/442
5,348,074 A * 9/1994 Streubel ..... B22D 11/128 164/413
5,839,502 A 11/1998 Ayata et al.
7,047,621 B2 * 5/2006 Zajber ..... B22D 11/009 29/33 C
2009/0100890 A1 * 4/2009 Kopp ..... B21B 1/0805 72/161
2010/0294012 A1 * 11/2010 Nakayama ..... B21B 27/021 72/206
2014/0166231 A1 * 6/2014 Milani ..... B22D 11/1206 164/476
2015/0047403 A1 * 2/2015 Imai ..... B22D 11/128 72/227

FOREIGN PATENT DOCUMENTS

JP 58-205655 A * 11/1983 ..... B22D 11/06
JP 61-132247 A 6/1986
JP 5-138321 A 6/1993
JP 6-210420 A 8/1994
JP 8-132205 A 5/1996
JP 10-328799 A 12/1998
JP 2000-312956 A 11/2000
JP 2004-058129 A 2/2004
JP 2009-279652 A 12/2009
JP 2013-086099 A 5/2013

OTHER PUBLICATIONS

Extended European Search Report for European Application No. 14792297.5, dated Jun. 23, 2016.
International Search Report issued in PCT/JP2014/061845, mailed on Aug. 12, 2014.
Written Opinion issued in PCT/JP2014/061845, mailed on Aug. 12, 2014.

* cited by examiner

CONTINUOUS CASTING EQUIPMENT

TECHNICAL FIELD

The present invention relates to continuous casting equipment including a casting product reduction apparatus and a casting product drawing apparatus, the casting product reduction apparatus being configured to apply reduction to a casting product, the casting product drawing apparatus being provided in the following stage of the casting product reduction apparatus and configured to sandwich and draw the casting product.

This application is based upon and claims the benefit of priority of the prior Japanese Patent Application No. 2013-096809, filed in Japan on May 2, 2013, the entire contents of which are incorporated herein by reference.

BACKGROUND ART

For example, in continuous casting for steel, molten steel poured into a mold is cooled by a cooling means, whereby a solidified shell grows and a casting product is drawn from below the mold. Here, the casting product drawn from the mold is not completely solidified at the point in time when coming out of the mold but has an unsolidified portion therein. Therefore, there is a possibility that so-called bulging deformation of the casting product being deformed to bulge out occurs due to static pressure of the molten steel in the mold. The bulging deformation may cause internal defects such as center segregation and porosity in a width-direction center region of the casting product where the unsolidified portion is present.

To suppress the internal defects such as center segregation and porosity due to the bulging deformation, continuous casting equipment provided with a casting product reduction apparatus that applies pressure to long side surfaces of the casting product drawn from the mold is suggested, for example, in Patent Documents 1 and 2. Here, in the casting product reduction apparatus described in Patent Document 2, a casting product reduction roll in contact with the casting product is composed of divided rolls divided in an axial direction, and bearing parts that are arranged between divided rolls adjacent in the axial direction.

Here, since the unsolidified portion is present in the width-direction center region of the casting product, by applying reduction only to the width-direction center region of the casting product, even when the reduction load is reduced, it is possible to prevent the internal defects such as center segregation and porosity due to the bulging deformation.

Accordingly, for example, Patent Documents 3, 4, and 5 suggest methods and apparatuses for applying reduction to a casting product by use of casting product reduction rolls including a large-diameter part that projects radially outward in an axial-direction center region.

PRIOR ART DOCUMENTS

Patent Documents

[Patent Document 1] JP H10-328799A
[Patent Document 2] JP 2000-312956A
[Patent Document 3] JP H06-210420A
[Patent Document 4] JP 2009-279652A
[Patent Document 5] JP S61-132247A

SUMMARY OF THE INVENTION

Problem(s) to be Solved by the Invention

In the above-described continuous casting equipment, generally, the casting product drawing apparatus including casting product drawing rolls that sandwich and draw the casting product is arranged in the following stage of the casting product reduction apparatus that applies pressure to long side surfaces of the casting product.

Here, as shown in Patent Documents 3, 4, and 5, in a case where the casting product reduction rolls including a large-diameter part apply reduction to part of the long side surfaces of the casting product, a depressed part corresponding to the large-diameter part is formed on a long side surface of the casting product. When the casting product on which the depressed part is formed is sandwiched in the casting product drawing apparatus, the casting product drawing rolls do not contact with a region where the depressed part is found, thereby the contact area of the casting product drawing rolls and the casting product is reduced. Therefore, unfortunately, the casting product drawing rolls have been unevenly worn, and the roll lifetime has become shortened. In addition, the drawing power for the casting product may become insufficient, and stable casting may become impossible.

As described in Patent Document 2, in the casting product drawing apparatus, the casting product drawing rolls may be composed of divided rolls divided in an axial direction. Also in this case, since the casting product is sandwiched only by the divided rolls corresponding to the region other than the depressed part, part of the divided rolls may be worn. In addition, since all the load is placed on the bearing parts of the divided rolls sandwiching the casting product, the bearing parts may be damaged in an early stage.

The present invention has been made in view of the above-described circumstances, and aims to provide continuous casting equipment including a casting product drawing apparatus that can surely sandwich and draw even a casting product on a long side surface of which a depressed part is formed by reduction of a casting product reduction apparatus, so as to extend the roll lifetime of the casting product drawing rolls to be longer than before and to enable stable casting.

Means for Solving the Problem(s)

To solve the above described problems, the continuous casting equipment according to the present invention is continuous casting equipment including: a casting product reduction apparatus configured to apply reduction to a casting product; and a casting product drawing apparatus provided in a following stage of the casting product reduction apparatus and configured to sandwich and draw the casting product. The casting product reduction apparatus includes a pair of casting product reduction rolls that sandwich and apply pressure to the casting product, in which at least one of the pair of casting product reduction rolls sandwiching the casting product includes a large-diameter part that projects radially outward in an axial-direction center region and applies pressure to a width-direction center region of the casting product. The casting product that is subjected to reduction by the casting product reduction apparatus has a depressed part corresponding to the large-diameter part. The casting product drawing apparatus includes a pair of casting product drawing rolls that sandwich the casting product, in which at least one of the pair of casting product drawing rolls includes a depressed part supporting part that contacts with and supports the depressed part, and is driven by a driving mechanism. An axial-direction length $L_2$ of the depressed part supporting part and an axial-direction length $L_1$ of the large-diameter part forming the depressed part satisfy $0.5 \times L_1 \leq L_2 < L_1$.

In the continuous casting equipment of the present invention, the casting product drawing apparatus includes the pair of casting product drawing rolls that sandwich the casting product, in which at least one of the pair of casting product drawing rolls includes the depressed part supporting part that contacts with and supports the depressed part formed on a long side surface of the casting product, and is driven by the driving mechanism, and the axial-direction length $L_2$ of the depressed part supporting part and the axial-direction length $L_1$ of the large-diameter part forming the depressed part satisfy $0.5 \times L_1 \leq L_2 < L_1$. Therefore, even if the casting product includes a depressed part, the contact area of the depressed part and the casting product drawing rolls can be sufficiently secured. In addition, it is experimentally known that uneven wear of the casting product drawing rolls can be suppressed, the lifetime of the casting product drawing rolls can be extended, and stable casting can be performed with no shortage of the drawing power for the casting product.

Note that the casting product drawing rolls typically include a lifting apparatus such as an oil-hydraulic cylinder, and a depressed part supporting part can be set at a position in contact with the depressed part of the casting product.

Here, in the continuous casting equipment of the present invention, it is preferable that the casting product reduction roll includes a small-diameter part extending at both ends of the large-diameter part in a casting product width direction, the casting product drawing roll includes a small-diameter part extending at both ends of the depressed part supporting part in the casting product width direction, and a difference H and a difference H' has a relation of $H \leq H'$, the difference H being a difference between a radius of the large-diameter part and a radius of the small-diameter part of the casting product reduction roll, the difference H' being a difference between a radius of the depressed part supporting part and a radius of the small-diameter part of the casting product drawing roll.

In this case, since the depth of the depressed part does not become greater than the difference H between the radius of the large-diameter part and the radius of the small-diameter part of the casting product reduction roll, if the difference H' between the radius of the depressed part supporting part and the radius of the small-diameter part of the casting product drawing rolls is greater than or equal to the difference H ($H \leq H'$), the depressed part supporting part is surely in contact with the depressed part, thereby the casting product drawing rolls can surely sandwich and draw the casting product.

Note that the continuous casting equipment of the present invention may be configured in a manner that the casting product drawing rolls are composed of divided rolls divided in an axial direction, and the plurality of divided rolls may be provided with the depressed part supporting part. In this case, since the casting product drawing rolls are composed of the divided rolls divided in an axial direction, the load on a divided roll can be reduced, and the casting product drawing apparatus can be downsized. Furthermore, the load can be received by the plurality of bearing parts, and the lifetime of the bearing parts can be extended.

Effect(s) of the Invention

As described above, according to the present disclosure, it becomes possible to provide continuous casting equipment including a casting product drawing apparatus that can surely sandwich and draw even a casting product on a long side surface of which a depressed part is formed by reduction of a casting product reduction apparatus, so as to extend the roll lifetime of the casting product drawing rolls to be longer than before and to enable stable casting.

BRIEF DESCRIPTION OF THE DRAWING(S)

MODE(S) FOR CARRYING OUT THE INVENTION

Figure 1:
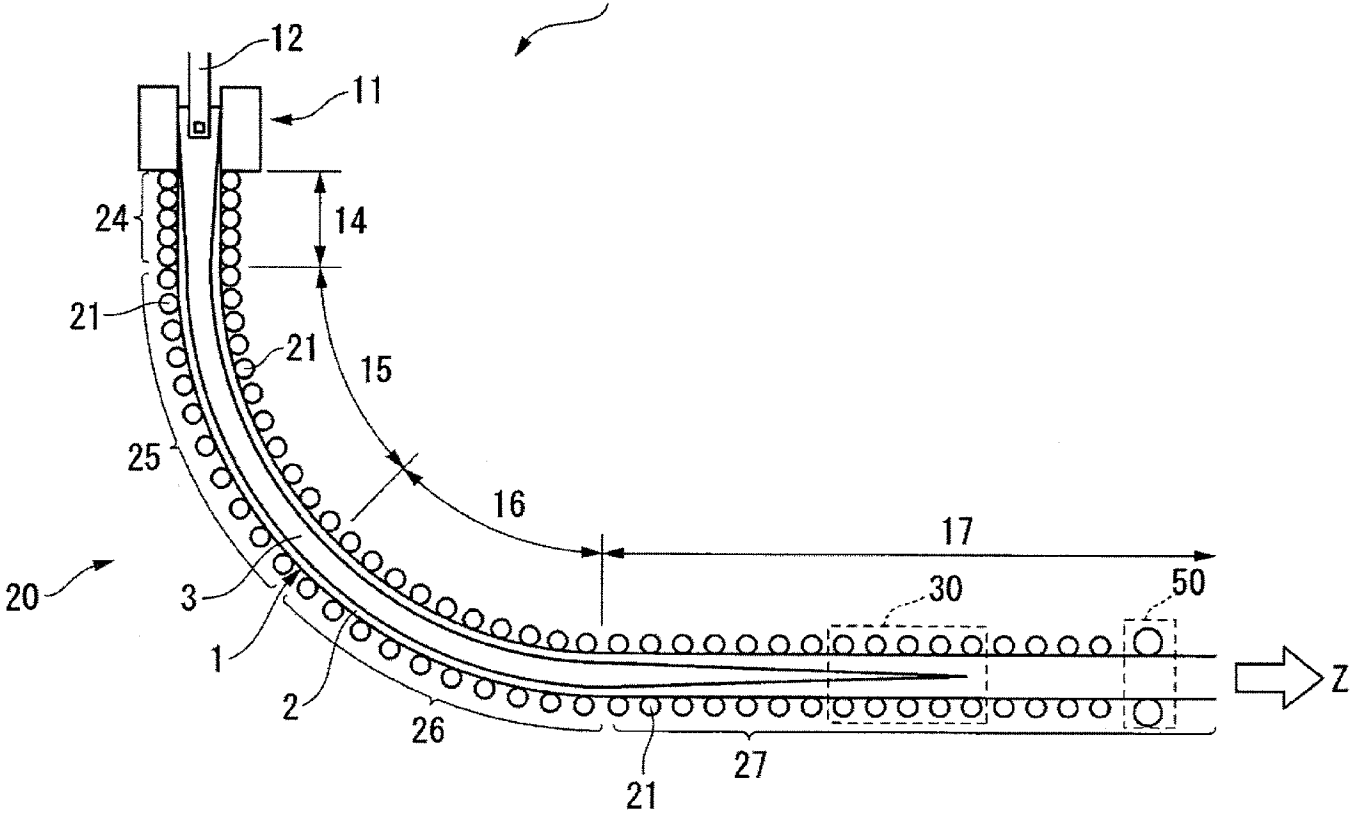
FIG. 1 is a schematic explanatory diagram of a continuous casting apparatus that is an embodiment of the present invention.

Hereinafter, continuous casting equipment that is an embodiment of the present invention will be described with reference to the accompanying drawings. Note that the present invention is not limited to the following embodiment.

Continuous casting equipment 10 illustrated in FIG. 1 includes a water-cooled mold 11, a casting product supporting roll group 20 composed of a plurality of casting product supporting rolls 21 located below the water-cooled mold 11, a casting product reduction apparatus 30 that applies pressure to a casting product 1 in the thickness direction, and a casting product drawing apparatus 50 that sandwiches and draws the casting product 1 toward a drawing direction Z. Note that the continuous casting equipment 10 that is the present embodiment is configured as a vertical bending continuous casting machine that has a vertical zone 14 that draws downward the casting product 1 drawn from the water-cooled mold 11, a bending zone 15 that bends the casting product 1, a straightening zone 16 that bends back the bent casting product 1, and a horizontal zone 17 that conveys the casting product 1 in the horizontal direction.

The water-cooled mold 11 is in a cylindrical shape having a rectangular hole, and the casting product 1 having a cross section according to the shape of the rectangular hole is drawn out. For example, a water-cooled mold with a long side length of the rectangular hole (corresponding to the width of the casting product 1) set to 900 to 2300 mm and a short side length of the rectangular hole (corresponding to the thickness of the casting product 1) set to 150 to 400 mm can be exemplified, but the water-cooled mold 11 is not limited to this.

The water-cooled mold 11 is further provided with a primary cooling means (not illustrated) for cooling molten steel in the rectangular hole.

The casting product supporting roll group 20 includes a pinch roll part 24 located at the vertical zone 14, a bending roll part 25 located at the bending zone 15, a straightening roll part 26 located at the straightening zone 16, and a horizontal roll part 27 located at the horizontal zone 17.

Here, the casting product supporting rolls 21 included in the casting product supporting roll group 20 are extended in the width direction of the casting product 1 and configured to support long side surfaces of the casting product 1.

Further, spray nozzles (not illustrated) that spray cooling water toward the long side surfaces of the casting product 1 are arranged as secondary cooling means, between the plurality of casting product supporting rolls 21 arranged at intervals in the drawing direction Z of the casting product 1.

The casting product reduction apparatus 30 is intended to apply reduction to the casting product 1 drawn from the water-cooled mold 11, in the thickness direction, and is arranged at the horizontal zone 17 in this embodiment so as to apply reduction to the casting product 1 in a region where a center solid phase ratio of the casting product 1 is 0.2 or more. However, without limitation to this, the casting product reduction apparatus 30 may be arranged at any of the vertical zone 14, the bending zone 15, and the straightening zone 16.

Figure 2:
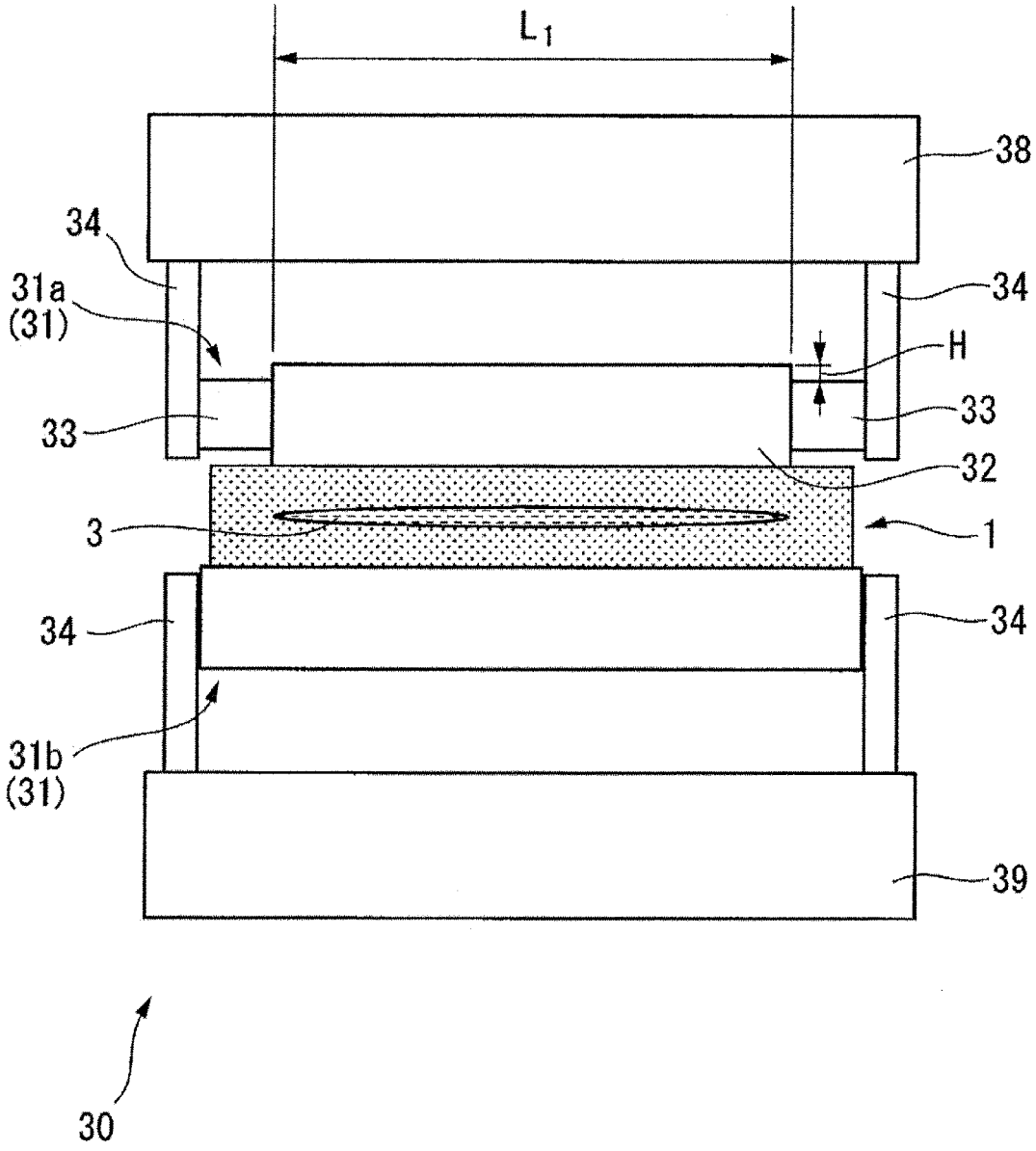
FIG. 2 is an explanatory diagram of a casting product reduction apparatus provided in the continuous casting apparatus of FIG. 1, seen from a down-stream side in a drawing direction.

As illustrated in FIG. 2, the casting product reduction apparatus 30 includes casting product reduction rolls 31 that are in contact with long side surfaces of the casting product 1, a first frame 38 arranged on a one long side surface side of the casting product 1 (on the upper side in FIG. 2), and a second frame 39 arranged on the other long side surface side of the casting product 1 (on the lower side in FIG. 2).

The first frame 38 pivotally supports a first casting product reduction roll 31*a* that is in contact with the one long side surface side of the casting product 1, via bearing parts 34, and the second frame 39 pivotally supports a second casting product reduction roll 31*b* that is in contact with the other long side surface side of the casting product 1, via the bearing parts 34.

Here, the first casting product reduction roll 31*a* that is pivotally supported by the first frame 38, i.e., supported by the first frame 38 with a pivot so as to be rotatable, includes a large-diameter part 32 that projects radially outward in an axial-direction center region thereof and a small-diameter parts 33 located at both ends of the large-diameter part 32, as illustrated in FIG. 2.

On the other hand, the second casting product reduction roll 31*b* that is pivotally supported by the second frame 39 has a constant diameter in the axial direction.

In this embodiment, the first casting product reduction roll 31*a* is configured to apply pressure to a width-direction center region of the casting product 1 where the large-diameter part 32 is located, and not to apply pressure to side edge regions of the casting product 1 where the small-diameter parts 33 are located.

Figure 3:
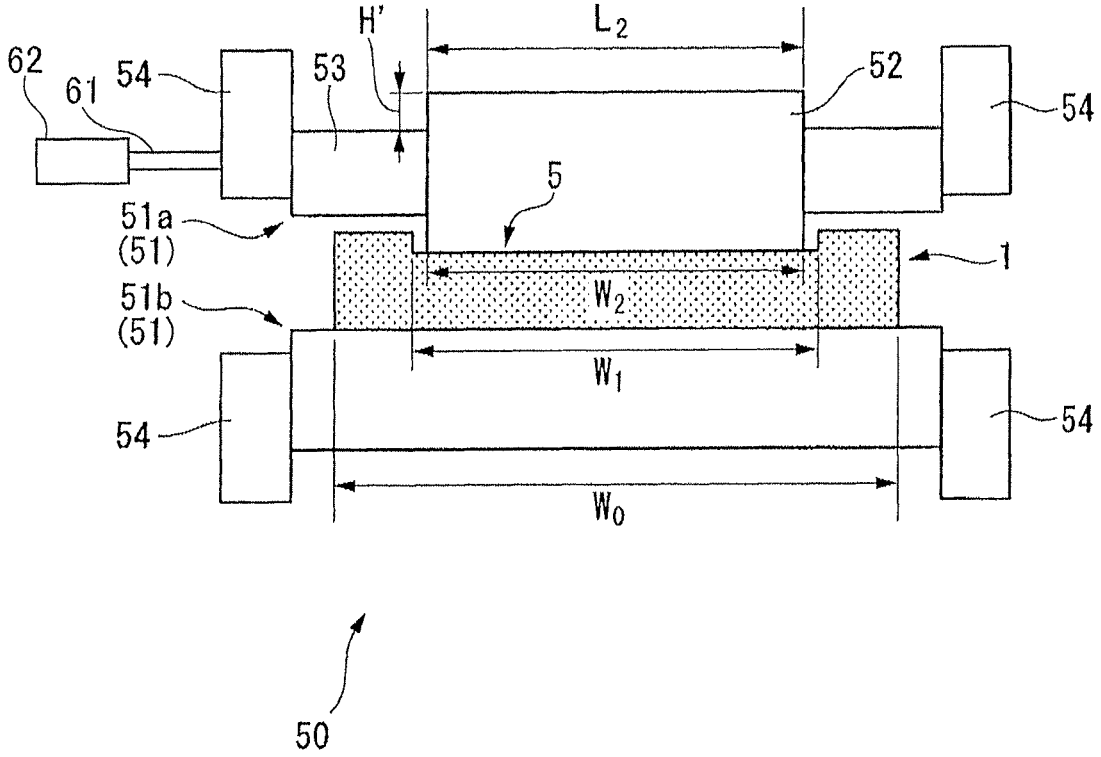
FIG. 3 is an explanatory diagram of a casting product drawing apparatus provided in the continuous casting apparatus of FIG. 1, seen from the down-stream side in the drawing direction.

In the casting product 1 to which pressure is applied by the casting product reduction apparatus 30 having the above configuration, as illustrated in FIG. 3, a depressed part 5 corresponding to the large-diameter part 32 is formed on one of the long side surfaces. Here, a casting product width-direction length $W_1$ of the depressed part 5 and a width-direction length $W_0$ of the casting product 1 are configured to have a relation of $W_1>(W_0-W_1)$. That is, the casting product width-direction length $W_1$ of the depressed part 5 is longer than the casting product width-direction length $(W_0-W_1)$ in a region where the depressed part is not formed.

Next, the casting product drawing apparatus 50 will be described. As illustrated in FIG. 1, the casting product drawing apparatus 50 is arranged in the following stage of the casting product reduction apparatus 30, and is configured to sandwich and draw the casting product 1 on a long side surface of which the depressed part 5 is formed by the casting product reduction apparatus 30, as described above.

As illustrated in FIG. 3, the casting product drawing apparatus 50 includes a pair of casting product drawing rolls 51 (a first casting product drawing roll 51*a* and a second casting product drawing roll 51*b*) that sandwich the casting product 1, and is configured in a manner that the first casting product drawing roll 51*a* is in contact with one of the long side surfaces of the casting product 1 and the second casting product drawing roll 51*b* is in contact with the other of the long side surfaces of the casting product 1. The first casting product drawing roll 51*a* and the second casting product drawing roll 51*b* are each pivotally supported by bearing parts 54.

Here, the first casting product drawing roll 51*a* is provided with a depressed part supporting part 52 and small-diameter parts 53, the depressed part supporting part 52 projecting radially outward and contacting and supporting the depressed part 5 formed on the casting product 1, the small-diameter parts 53 being located at both ends of the depressed part supporting part 52.

An axial-direction length $L_2$ of the depressed part supporting part 52 and an axial-direction length $L_1$ of the large-diameter part 32 of the first casting product reduction roll 31*a* are configured to satisfy $0.5\times L_1\leq L_2<L_1$. Further, a contact length $W_2$ of the depressed part supporting part 52 and the depressed part 5, the width-direction length $W_0$ of the casting product 1, and the casting product width-direction length $W_1$ of the depressed part 5 are configured to satisfy $(W_0-W_1)<W_2<W_1$.

On the other hand, the second casting product drawing roll 51*b* that is in contact with the other of the long side surfaces of the casting product 1 has a constant diameter in the axial direction.

In the above pair of casting product drawing rolls 51, the first casting product drawing roll 51*a* having the depressed part supporting part 52 is connected to a driving mechanism 62 such as a motor, via a driving transmission mechanism 61 such as a universal joint, and is driven by the driving mechanism 62. That is, by the function of the driving mechanism 62, a rotation driving force is given to the first casting product drawing roll 51*a* in the drawing direction. In this case, the driving mechanism may also drive the second casting product drawing roll 51*b* in the drawing direction.

Note that, in the present embodiment, as illustrated in FIG. 1, the casting product reduction apparatus 30 and the casting product drawing apparatus 50 are arranged at the horizontal zone 17.

In addition, in the present embodiment, a difference H and a difference H' has a relation of $H\leq H'$, the difference H being a difference between the radius of the large-diameter part 32 and the small-diameter part 33 of the first casting product reduction roll 31*a* (see FIG. 2), the difference H' being a difference between the radius of the depressed part supporting part 52 and the radius of the small-diameter part 53 of the first casting product drawing roll 51*a* (see FIG. 3).

In the continuous casting equipment 10 having such a configuration, molten steel is poured into the water-cooled mold 11 via an immersion nozzle 12 inserted into the water-cooled mold 11 and cooled by the primary cooling means of the water-cooled mold 11, whereby a solidified shell 2 grows and the casting product 1 is drawn from below the water-cooled mold 11. In this event, as illustrated in FIGS. 1 and 2, an unsolidified portion 3 is present in the casting product 1.

This casting product 1 is drawn out downward by the pinch roll part 24 and bent by the bending roll part 25 as illustrated in FIG. 1. Then, the casting product 1 is bent back by the straightening roll part 26 and then conveyed in the horizontal direction by the horizontal roll part 27.

In this event, the cooling water is sprayed toward the casting product 1 from the spray nozzles provided between the casting product supporting rolls 21 of the pinch roll part 24, the bending roll part 25, the straightening roll part 26, and so on, to cool the casting product 1, whereby the solidified shell 2 further grows.

Then, in the following stage of the horizontal zone 17 where the casting product 1 is drawn out in the horizontal direction, the casting product 1 completely solidifies.

In this event, the casting product 1 drawn from the water-cooled mold 11 is subjected to reduction by the casting product reduction apparatus 30 being this embodiment in the region where the center solid phase ratio becomes 0.2 or more, for example.

Then, the casting product 1 that has been subjected to reduction by the casting product reduction apparatus 30 is sandwiched by the casting product drawing apparatus 50 and drawn toward the drawing direction Z. In this manner, the casting product 1 is manufactured continuously.

In the continuous casting equipment 10 being this embodiment and having the above-described configuration, the casting product drawing apparatus 50 includes the pair of casting product drawing rolls 51 (the first casting product drawing roll 51*a* and the second casting product drawing roll 51*b*) sandwiching the casting product 1, and the first casting product drawing roll 51*a* includes the depressed part supporting part 52 that contacts with and supports the depressed part 5 formed on a long side surface of the casting product 1. Since the axial-direction length $L_2$ of the depressed part supporting part 52 and the axial-direction length $L_1$ of the large-diameter part 32 forming the depressed part 5 satisfy $0.5\times L_1 \leq L_2 < L_1$, the contact area of the first casting product drawing roll 51*a* and the depressed part 5 can be secured. Thus, uneven wear of the casting product drawing rolls 51 can be suppressed, and the lifetime of the casting product drawing rolls 51 can be extended. Furthermore, stable casting can be performed with no shortage of the drawing power for the casting product 1.

In addition, in this embodiment, the difference H and the difference H' has the relation of $H \leq H'$, the difference H being a difference between the radius of the large-diameter part 32 and the radius of the small-diameter part 33 of the first casting product reduction roll 31*a*, the difference H' being a difference between the radius of the depressed part supporting part 52 and the radius of the small-diameter part 53 of the first casting product drawing roll 51*a*. Accordingly, the depressed part supporting part 52 is surely in contact with the depressed part 5 formed by the large-diameter part 32, thereby the casting product drawing rolls 51 can surely sandwich the casting product 1.

In addition, in this embodiment, since the contact length $W_2$ of the depressed part supporting part 52 and the depressed part 5, the width-direction length $W_0$ of the casting product 1, and the casting product width-direction length $W_1$ of the depressed part 5 formed by the large-diameter part 32 are configured to satisfy $(W_0-W_1) < W_2 < W_1$, the contact area of the casting product 1 and the casting product drawing rolls 51 can be secured sufficiently.

Furthermore, the first casting product reduction roll 31*a* of the casting product reduction apparatus 30 includes the large-diameter part 32 projecting radially outward in the axial-direction center region and the small-diameter parts 33 extending at both ends of the large-diameter part 32, and the casting product reduction rolls 31 are configured to apply pressure to the width-direction center region of the casting product 1 where the large-diameter part 32 is located, and not to apply pressure to the side edge regions of the casting product 1 where the small-diameter parts 33 are located. Accordingly, it is possible to apply reduction only to the width-direction center region of the casting product 1 in which the unsolidified portion 3 is present. Thus, the reduction load is can be reduced significantly.

In addition, in this embodiment, the casting product reduction apparatus 30 being the present embodiment applies reduction in the region where the center solid phase ratio is 0.2 or more. Accordingly, it is possible to suppress the generation of center segregation and porosity.

Incidentally, it is experimentally known that problems such as center segregation and porosity occur at the center solid phase ratio of the casting product 1 of 0.2 or more. The effects of the present invention become conspicuous by applying reduction in a region of a solid phase ratio of 0.2 or more, and therefore it is preferable to apply reduction in a region of a center solid phase ratio of the casting product 1 of 0.2 or more. On the other hand, the upper limit of the center solid phase ratio of the casting product 1 is 1.0 because it is the region where the problems such as center segregation and porosity occur.

Note that the center solid phase ratio can be defined as a solid phase ratio of a central portion in the casting product thickness direction and a molten portion in the casting product width direction.

Further, the center solid phase ratio can be found by a heat transfer solidification calculation, and the enthalpy method, the equivalent specific heat method, and so on are widely known as the heat transfer solidification calculation, any of which may be used. Further, for a simple method, the following expression is widely known and may be used.

Center solid phase ratio=(liquidus temperature−molten portion temperature)/(liquidus temperature−solidus temperature)

In the above, the molten portion temperature means the temperature of the central portion in the casting product thickness direction and the molten portion in the casting product width direction, and can be found by the heat transfer solidification calculation. Further, the liquidus temperature can be calculated by referring to, for example, "Tetsu to Hagane, The journal of The Iron and Steel Institute of Japan, Vol. 55. No. 3 (19690227) S85, The Iron and Steel Institute of Japan", and the solidus temperature can be calculated by referring to, for example, "Hirai, Kanemaru, Mori: 19th Committee, Japan Society for the Promotion of Science, Fifth Solidification Phenomena Conference Material, Solidification 46 (December 1968)".

The continuous casting equipment being an embodiment of the present invention has been described above, but the present invention is not limited to the embodiment and can be variously modified as necessary without departing from the scope of the technical spirit of the invention.

For example, the present embodiment has been made by taking an example of the vertical bending continuous casting machine as illustrated in FIG. 1, but the present invention is not limited to this, and can be applied to continuous casting equipment of another system, such as a curving continuous casting machine or vertical continuous casting machine. Here, in the vertical continuous casting machine, it is necessary to sandwich and hold the casting product surely by the casting product drawing apparatus; therefore, the application of the present invention is particularly effective.

Figure 4:
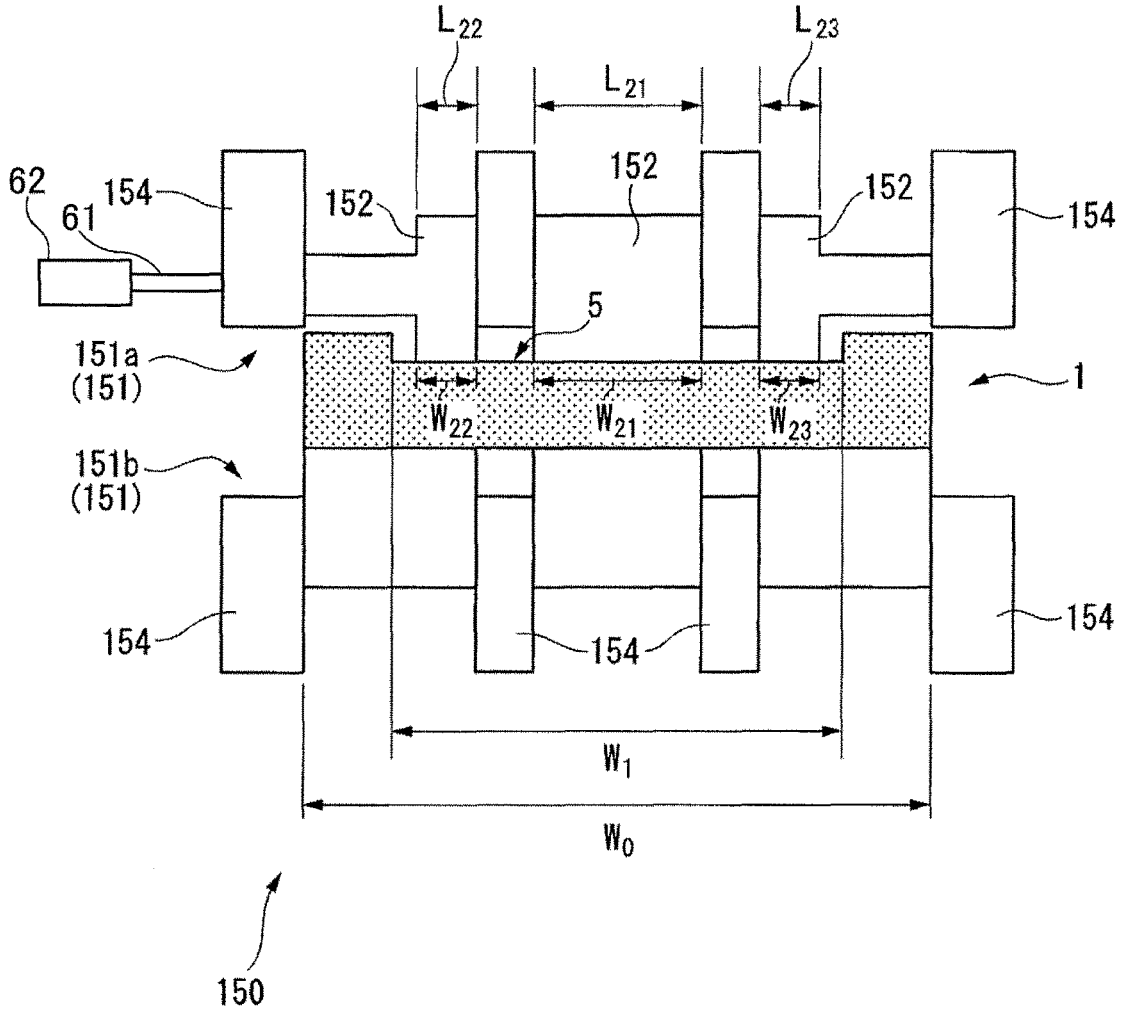
FIG. 4 is an explanatory diagram of a casting product drawing apparatus provided in a continuous casting apparatus that is another embodiment of the present invention, seen from a down-stream side in a drawing direction.

As illustrated in FIG. 4, the casting product drawing rolls 151 of the casting product drawing apparatus 150 may be composed of divided rolls divided in an axial direction. That is, as the casting product drawing rolls 151, a first casting product drawing roll 151*a* and a second casting product drawing roll 151*b* are arranged to face each other so that the casting product 1 is sandwiched and moved in the drawing direction. Alternatively, each of the first casting product drawing roll 151*a* and the second casting product drawing roll 151*b* may be configured as divided rolls.

In this case, it is preferable that the plurality of divided rolls are provided with a depressed part supporting part 152 that is in contact with the depressed part 5 of the casting product 1. The axial-direction length $L_2$ (the sum of $L_{21}$, $L_{22}$, and $L_{23}$ in FIG. 4) of the depressed part supporting part 152 of each divided roll is in the range of $0.5\times L_1<(L_{21}+L_{22}+L_{23})<L_1$. Further, it is preferable that the contact length $W_2$ (the sum of $W_{21}$, $W_{22}$, and $W_{23}$ in FIG. 4) of the depressed part supporting part 152 of each divided roll and the depressed part 5 is in the range of $(W_0-W_1)<(W_{21}+W_{22}+W_{23})<W_1$.

Also in the casting product drawing rolls 151 having such a configuration of divided rolls, the first casting product drawing roll 151*a* having the depressed part supporting part 152 is connected to the driving mechanism 62 such as a motor, via the driving transmission mechanism 61 such as a universal joint, and is driven by the driving mechanism 62. That is, by the function of the driving mechanism 62, a rotation driving force is given to the first casting product drawing roll 151*a* in the drawing direction. The driving mechanism may also drive the second casting product drawing roll 151*b* in the drawing direction.

As illustrated in FIG. 4, in a case where the casting product drawing rolls 151 of the casting product drawing apparatus 150 are composed of divided rolls divided in an axial direction, the load on a divided roll can be reduced, and the casting product drawing apparatus 150 can be downsized. Furthermore, the load can be received by a plurality of bearing parts 154, and the lifetime of the bearing parts 154 can be extended.

In the present embodiment, the large-diameter part is provided in the first casting product reduction roll in the casting product reduction apparatus. However, without limitation to this, the large-diameter part may be provided in each of the first casting product reduction roll and the second casting product reduction roll. In this case, in the casting product drawing apparatus, the depressed part supporting part is preferably provided in each of the first casting product drawing roll and the second casting product drawing roll.

The following shows the results of experiments that were performed to confirm the effects of the present invention.

In the continuous casting equipment including the casting product reduction apparatus described in the embodiment, casting was performed by modifying the shapes of the casting product drawing rolls of the casting product drawing apparatus, and the wearing amounts of the casting product drawing rolls were evaluated.

Here, the axial-direction length $L_1$ of the large-diameter part of the casting product reduction apparatus was set to 1900 mm. In addition, the width-direction length of the casting product was set to 2200 mm, and the casting product width-direction length of the depressed part formed on the casting product by the casting product reduction apparatus was also set to 1900 mm.

The casting product drawing rolls were set at a position where the depressed part supporting part is in contact with the depressed part of the casting product by a lifting apparatus. Further, the difference H between the radius of the large-diameter part and the radius of the small-diameter part of the casting product reduction roll was equal to the difference H' (H=H') between the radius of the depressed part supporting part and the radius of the small-diameter part of a casting product drawing roll.

In Comparative example, the casting product drawing rolls of the casting product drawing apparatus had a configuration in which the diameter was constant in the axial direction and had no contact with the depressed part.

In contrast, in Inventive example 1, a casting product drawing roll of the casting product drawing apparatus was provided with the depressed part supporting, and the axial-direction length $L_2$ of the depressed part supporting part was set to 1805 mm (i.e., $0.95\times L_1$).

Meanwhile, in Inventive example 2, a casting product drawing roll of the casting product drawing apparatus was provided with the depressed part supporting, and the axial-direction length $L_2$ of the depressed part supporting part was set to 1330 mm (i.e., $0.70\times L_1$).

In addition, in Inventive example 3, a casting product drawing roll of the casting product drawing apparatus was provided with the depressed part supporting, and the axial-direction length $L_3$ of the depressed part supporting part was set to 950 mm (i.e., $0.50\times L_1$).

The period of time when the casting product drawing roll of the casting product drawing apparatus became so small as to have a predetermined diameter at which exchange is necessary due to wear was evaluated. The evaluation results are shown in Table 1. Note that Table 1 shows the results of relative evaluation in which the period of time in Comparative example was 1.

TABLE 1

| | Casting product | Large-diameter part of casting product reduction roll | | Depressed part supporting part of casting product drawing roll | | Contact length $W_2$ of | |
|---|---|---|---|---|---|---|---|
| | Width of casting product $W_0$ mm | Axial-direction length $L_1$ mm | Difference from small-diameter part H mm | Axial-direction length $L_2$ mm | Difference from small-diameter part H' mm | casting product drawing roll and casting product mm | Roll lifetime |
| Inventive example 1 | 2200 | 1900 | 10 | 1805 | 12 | 1805 | 6.02 |
| Inventive example 2 | | | | 1330 | 12 | 1330 | 4.43 |
| Inventive example 3 | | | | 950 | 12 | 950 | 3.17 |
| Comparative example | | | | — | — | 300 | 1.00 |

Inventive example 1 had a lifetime that is about six times as long as that of Comparative example. In addition, Inventive example 2 had a lifetime that is about 4.5 times as long as that of Comparative example. Furthermore, Inventive example 3 had a lifetime that is about three times as long as that of Comparative example.

From the above results, it is confirmed that the wear of the casting product drawing roll can be suppressed and stable casting can be performed according to Inventive examples.

Further from the above results, it is found that the wear of the casting product drawing roll can be suppressed sufficiently when the axial-direction length $L_2$ of the depressed part supporting part is 0.5 times or more as long as the axial-direction length $L_1$ of the large-diameter part that forms the depressed part. On the analogy of the results, it is considered that the wear of the casting product drawing roll can be suppressed even when the axial-direction length $L_2$ of the depressed part supporting part is 0.4 times, for example, as long as the axial-direction length $L_1$ of the large-diameter part that forms the depressed part. However, if the length is shorter than the half of the axial-direction length $L_1$ of the large-diameter part in this manner, the area in which the depressed part supporting part is in contact with the depressed part becomes too small, and an excessive pressure might be applied to the casting product via the casting product drawing rolls when the casting product is drawn. In this case, the quality of the casting product might be adversely affected. Therefore, considering this point, it is preferable to secure the axial-direction length $L_2$ of the depressed part supporting part that is preferably 0.5 times or more as long as the axial-direction length $L_1$ of the large-diameter part that forms the depressed part, more preferably $0.70 \times L_1$, even more preferably $0.80 \times L_1$.

REFERENCE SIGNS LIST

10 continuous casting equipment
30 casting product reduction apparatus
31 casting product reduction roll
32 large-diameter part
50 casting product drawing apparatus
51 casting product drawing roll
52 depressed part supporting part

The invention claimed is:

1. Continuous casting equipment comprising:

an area in which a casting product supporting roll group is provided including at least one of a vertical zone, a bending zone, a straightening zone, and a horizontal zone following the vertical zone;

the continuous casting equipment as a vertical bending continuous casting machine including the vertical zone, the bending zone, the straightening zone, and the horizontal zone following the vertical zone, the continuous casting equipment as a curving continuous casting machine including the bending zone, the straightening zone, and the horizontal zone, the continuous casting equipment as a vertical continuous casting machine including the vertical zone;

a casting product reduction apparatus, provided in any one of the vertical zone, the bending zone, the straightening zone, and the horizontal zone, configured to apply reduction to a casting product; and a casting product drawing apparatus provided in a following stage of the casting product reduction apparatus and configured to sandwich and draw the casting product, wherein the casting product reduction apparatus includes a pair of casting product reduction rolls that sandwich and apply pressure to the casting product, in which at least one of the pair of casting product reduction rolls sandwiching the casting product includes a large-diameter part that projects radially outward in an axial-direction center region and applies pressure to a width-direction center region of the casting product, wherein the casting product that is subjected to reduction by the casting product reduction apparatus has a depressed part corresponding to the large-diameter part, wherein the casting product drawing apparatus includes a pair of casting product drawing rolls that sandwich the casting product, in which at least one of the pair of casting product drawing rolls includes a depressed part supporting part that contacts with and supports the depressed part, and is driven by a driving mechanism, and wherein an axial-direction length $L_2$ of the depressed part supporting part and an axial-direction length $L_1$ of the large-diameter part forming the depressed part satisfy $0.5 \times L_1 \leq L_2 < L_1$.

2. The continuous casting equipment according to claim 1, wherein the casting product reduction roll includes a small-diameter part extending at both ends of the large-diameter part in a casting product width direction, wherein the casting product drawing roll includes a small-diameter part extending at both ends of the depressed part supporting part in the casting product width direction, and wherein a difference H and a difference H' has a relation of $H \leq H'$, the difference H being a difference between a radius of the large-diameter part and a radius of the small-diameter part of the casting product reduction roll, the difference H' being a difference between a radius of the depressed part supporting part and a radius of the small-diameter part of the casting product drawing roll.

* * * * *